US005911795A

United States Patent [19]

Tucker

[11] Patent Number: 5,911,795

[45] Date of Patent: Jun. 15, 1999

[54] HAMMER WITH VIBRATION DAMPER AND METHOD OF MAKING SAME

[75] Inventor: Curtis Allen Tucker, Tullahoma, Tenn.

[73] Assignee: The Stanley Works, New Britain, Conn.

[21] Appl. No.: 08/950,543

[22] Filed: Oct. 15, 1997

[51] Int. Cl.[6] ..... B25D 1/12

[52] U.S. Cl. ..... 81/22; 76/103

[58] Field of Search ..... 81/20, 22; 16/110 R, 16/116 R; 403/263, 267–269, 277; 76/103

[56] References Cited

U.S. PATENT DOCUMENTS

| | | |
|---|---|---|
| 2,067,751 | 1/1937 | Beegle . |
| 2,850,331 | 9/1958 | Curry et al. . |
| 2,884,969 | 5/1959 | Lay . |
| 2,917,349 | 12/1959 | Saylor et al. . |
| 3,208,724 | 9/1965 | Vaughan . |
| 4,811,947 | 3/1989 | Takatsuka et al. . |
| 4,936,586 | 6/1990 | Van Raemdonck . |
| 5,094,453 | 3/1992 | Douglas et al. . |
| 5,362,046 | 11/1994 | Sims . |
| 5,704,259 | 1/1998 | Riehle . |

*Primary Examiner*—D. S. Meislin

[57] ABSTRACT

A hand-held vibration-damped striking tool has a striking head and an elongated handle having a core member with spaced apertures along its length extending therethrough and a vibration-damping canister at the end of the core member. The canister has a peripheral wall and an intermediate transverse wall providing a cup portion at its one end firmly seating the core member, and a compartment portion in which is disposed the vibration-damper. The peripheral wall of the cup-shaped portion has apertures extending therethrough. A grip of resiliently compressible material encases the core member and canister, and the material of the grip extends through the apertures of the core member and cup portion of the canister to effect firm engagement therewith.

15 Claims, 3 Drawing Sheets

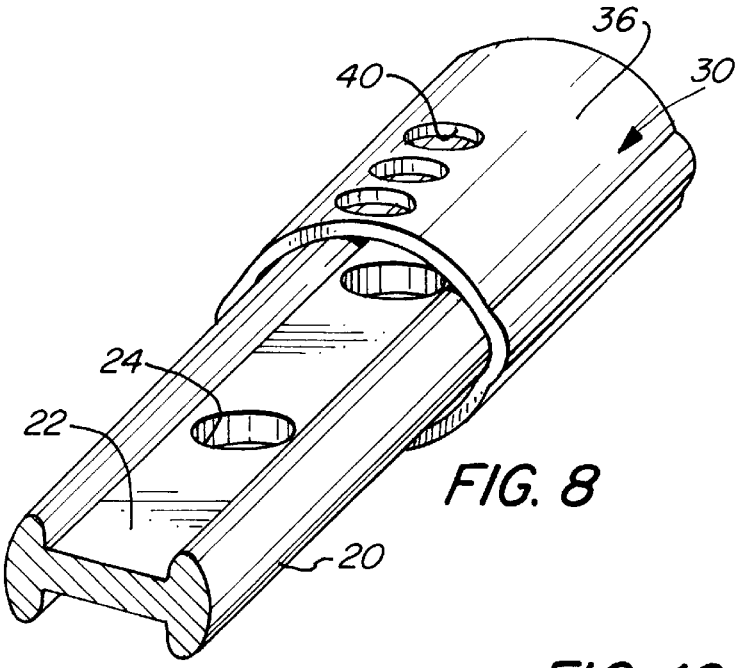
FIG. 8
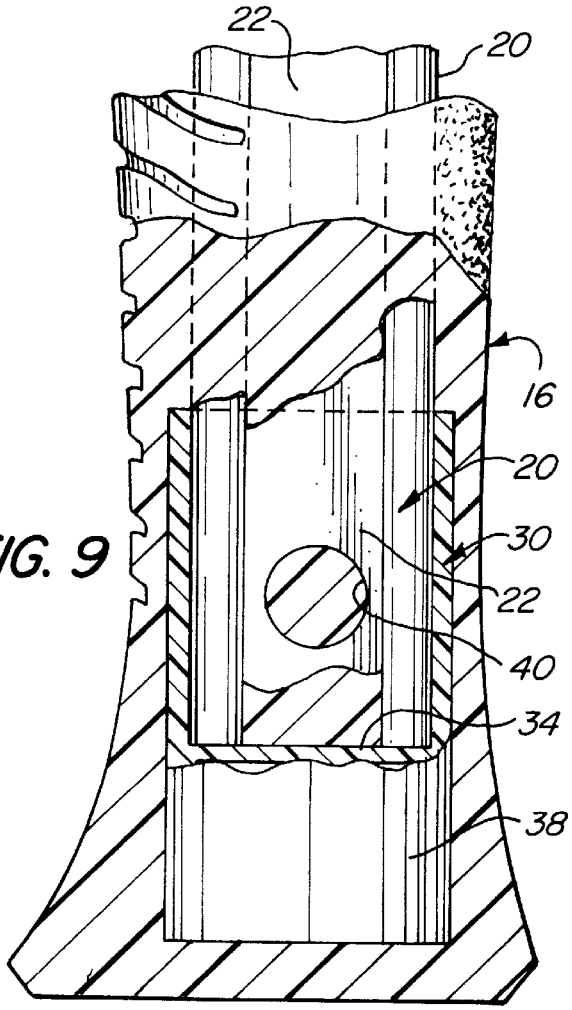
FIG. 9
FIG. 10
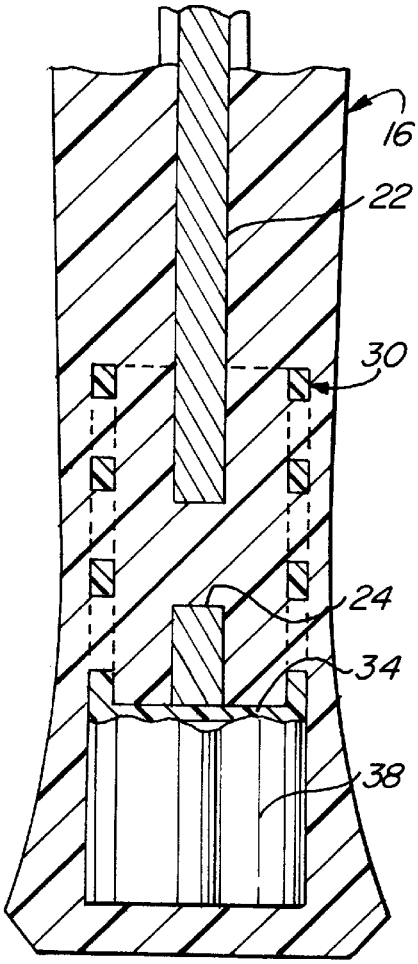

HAMMER WITH VIBRATION DAMPER AND METHOD OF MAKING SAME

BACKGROUND OF THE INVENTION

The present invention relates to hand-held striking tools and, more particularly, to such striking tools incorporating a vibration-damping element.

As is well known, tools for striking various objects such as hammers, sledges, rackets and the like exhibit substantial vibrations in the handle as a result of the impact. These vibrations are transmitted to the hand and arm of the person wielding the tool or racket and tend to produce fatigue and discomfort.

There have been a number of efforts to reduce the amount of vibrations which are transmitted to the user including providing damping material between the head and handle, production of composite handles incorporating substantial amounts of dampening material, incorporating damping devices within the handles themselves and fabrication of handles with natural frequencies tending to offset the frequency of vibration in the head. Exemplary of such efforts are Vaughn U.S. Pat. No. 3,208,728, Curry U.S. Pat. No. 2,850,331, Beegle U.S. Pat. No. 2,067,751, Saylor U.S. Pat. No. 2,917,349 and Vaughn U.S. Pat. No. 5,289,742.

Various problems are encountered in the incorporation of damping devices within the handle including the engagement of the damping device in a prescribed position within the handle, the effective transmittal of the vibrations from the head to the damping device, and the protection of the damping device from water, oil and other materials which might cause it to deteriorate. Exemplary of efforts to produce such damping devices are the handle structures shown in Simms U.S. Pat. No. 5,362,046 issued Nov. 8, 1994, Van-Raendonck U.S. Pat. No. 4,936,586 issued Jun. 26, 1990, Douglas et al U.S. Pat. No. 5,094,453 issued Mar. 10, 1992, and Takatusuka et al U.S. Pat. No. 4,811,947 issued Mar. 14, 1989.

Accordingly, it is an object of the present invention to provide a novel hand-held striking tool which incorporates a damping mechanism in the handle.

It is also an object to provide such a striking tool in which the damping mechanism is securely positioned within the handle and to which the vibrations are effectively transferred from the striking head.

Another object is to provide such a striking tool which can be simply and readily fabricated and assembled.

A further object is to provide a novel method for assembling a striking tool having a damping mechanism securely positioned within its handle.

SUMMARY OF THE INVENTION

It has now been found that the foregoing and related objects may be readily attained in a hand-held vibration-damped striking tool comprising a striking head having a recess and an elongated handle having one end seated in the recess of the head. The handle has a core member with one end extending into the recess and spaced apertures along its length extending therethrough.

A vibration-damping canister in the handle has a peripheral wall and an intermediate transverse wall providing a cup portion at its one end in which is firmly seated the other end of the core member. The canister has a compartment portion at its other end in which is disposed vibration-damping means, the peripheral wall of the cup-shaped portion has apertures extending therethrough.

A grip of resiliently compressible material encases the portion of the core member adjacent the other end thereof and the canister, and the material of the grip extends through the apertures of the core member and the cup portion of the canister to effect firm engagement therewith.

The core member is metallic, and has a generally I-shaped cross section with flanges and a web therebetween. The flanges abut the peripheral wall of the cup portion of the canister to transfer vibrations thereto.

Preferably, the canister has a generally oval cross section with major and minor axes, and the curvature of the peripheral wall at the ends of the major axis is defined by a radius which is shorter than that defining the remainder of the peripheral wall. The core member abuts the transverse wall of the canister and the peripheral wall at the ends of the major axis.

Desirably, the canister includes a cover extending across the other end thereof to seal the compartment portion, and the grip extends across the cover of the canister.

In making the hand-held vibration-damped striking tool, the steps comprising providing a striking head having a recess and forming a core member having spaced apertures along its length extending therethrough. A vibration-damping canister is formed with a peripheral wall and an intermediate transverse wall providing a cup portion at its one end and a compartment portion at its other end in which is disposed vibration-damping means. The peripheral wall of the cup-shaped portion has apertures extending therethrough.

The core member and the canister are placed in a mold with one end of the core rod firmly seated in the cup portion of the canister. Resiliently compressible material is molded about the core member and canister to encase the canister and the adjacent portion of the core member to provide a grip, and the material of the grip extends through the apertures of the core member and the cup portion of the canister to effect firm engagement therewith, and securing the other end of the core member in the recess of the striking head to provide the handle therefor.

BRIEF DESCRIPTION OF THE DRAWINGS

FIG. 8 is a perspective view showing a fragmentary portion of the core rod seated in the cup portion of the canister;

FIG. 9 is a fragmentary sectional view of the butt end of the handle with portions broken away to reveal internal construction; and FIG. 10 is a similar view rotated 90° from the position seen in FIG. 9.

DETAILED DESCRIPTION OF THE ILLUSTRATED EMBODIMENT

Figure 1:
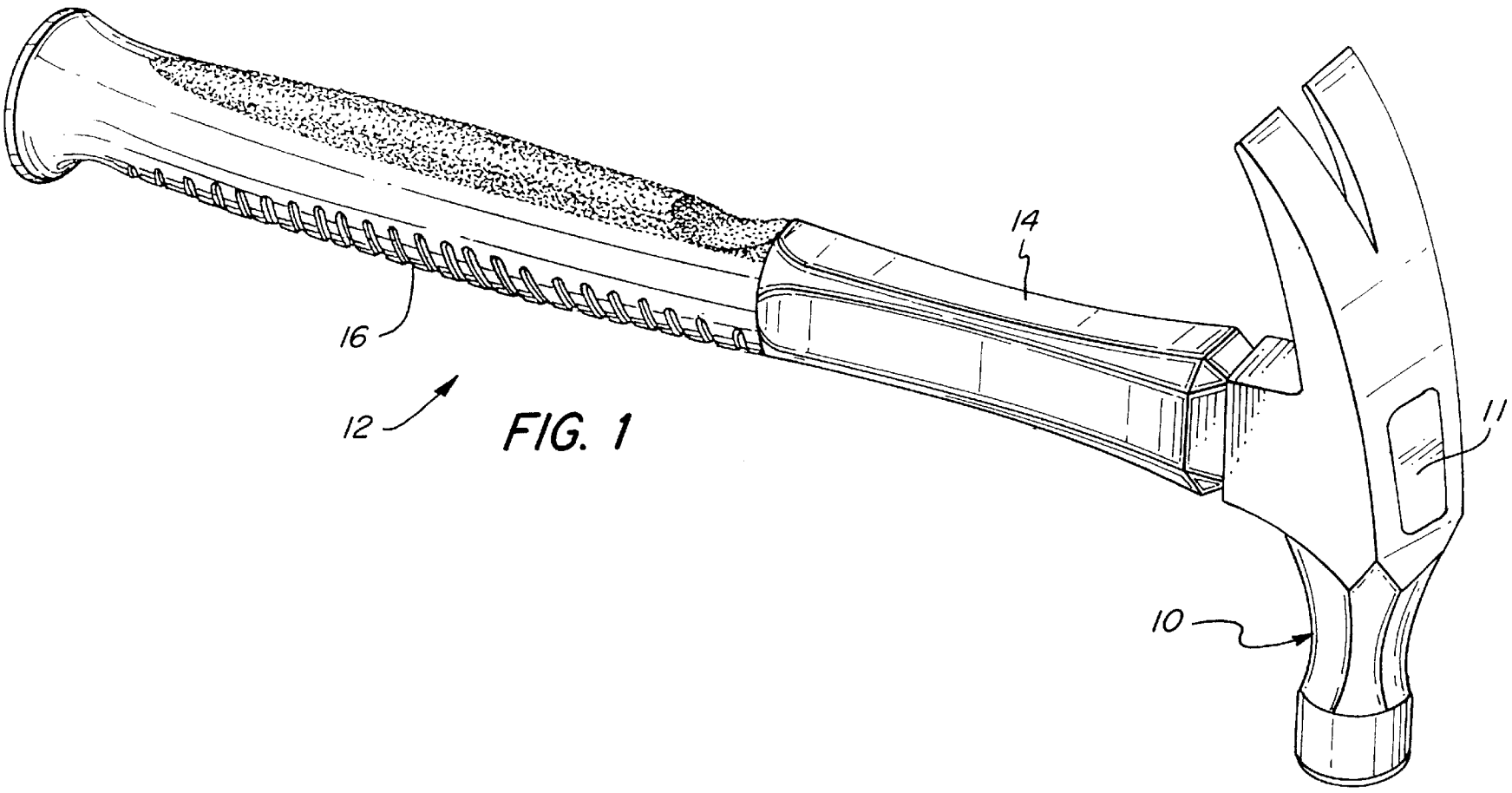
FIG. 1 is a perspective view of a hammer embodying the invention.
Figure 3:
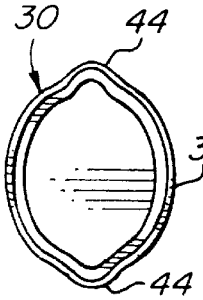
FIG. 3 is a bottom view of the canister.
Figure 4:
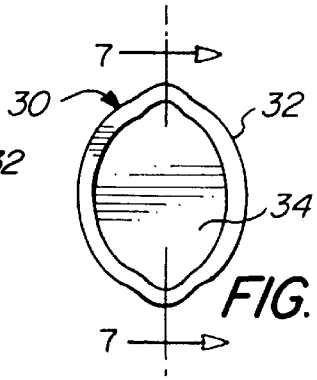
FIG. 4 is a top view of the canister.
Figure 5:
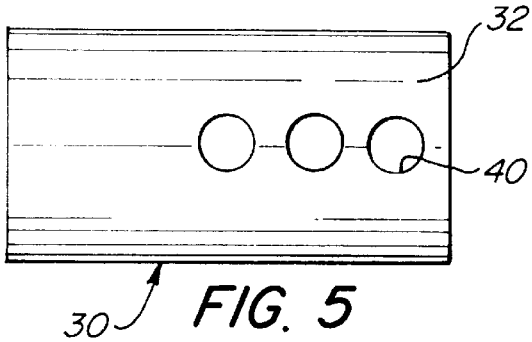
FIG. 5 is a side elevational view of the canister as seen along its major axis.
Figure 6:
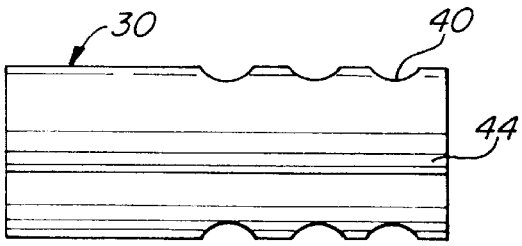
FIG. 6 is a side elevational view of the canister as seen along its minor axis.
Figure 7:
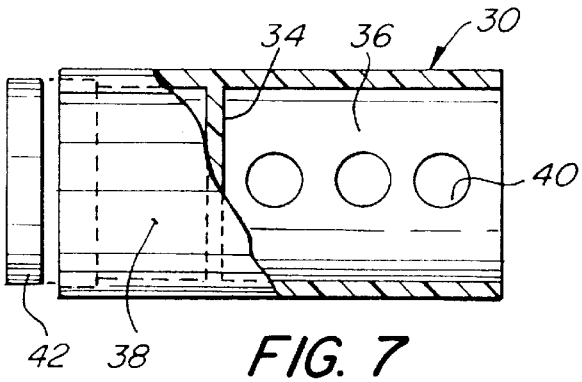
FIG. 7 is a partially sectioned view along the line 7—7 of FIG. 4.

Turning first to FIG. 1, therein illustrated is a hammer embodying the present invention generally comprised of a striking head generally designed by the numeral 10 with an eye or passage 11, and a handle generally designated by the numeral 12. The handle has a sleeve 14 extending along its portion adjacent the head 10 and a grip which extends from the sleeve 14 to the butt end of the handle 12

Figure 2:
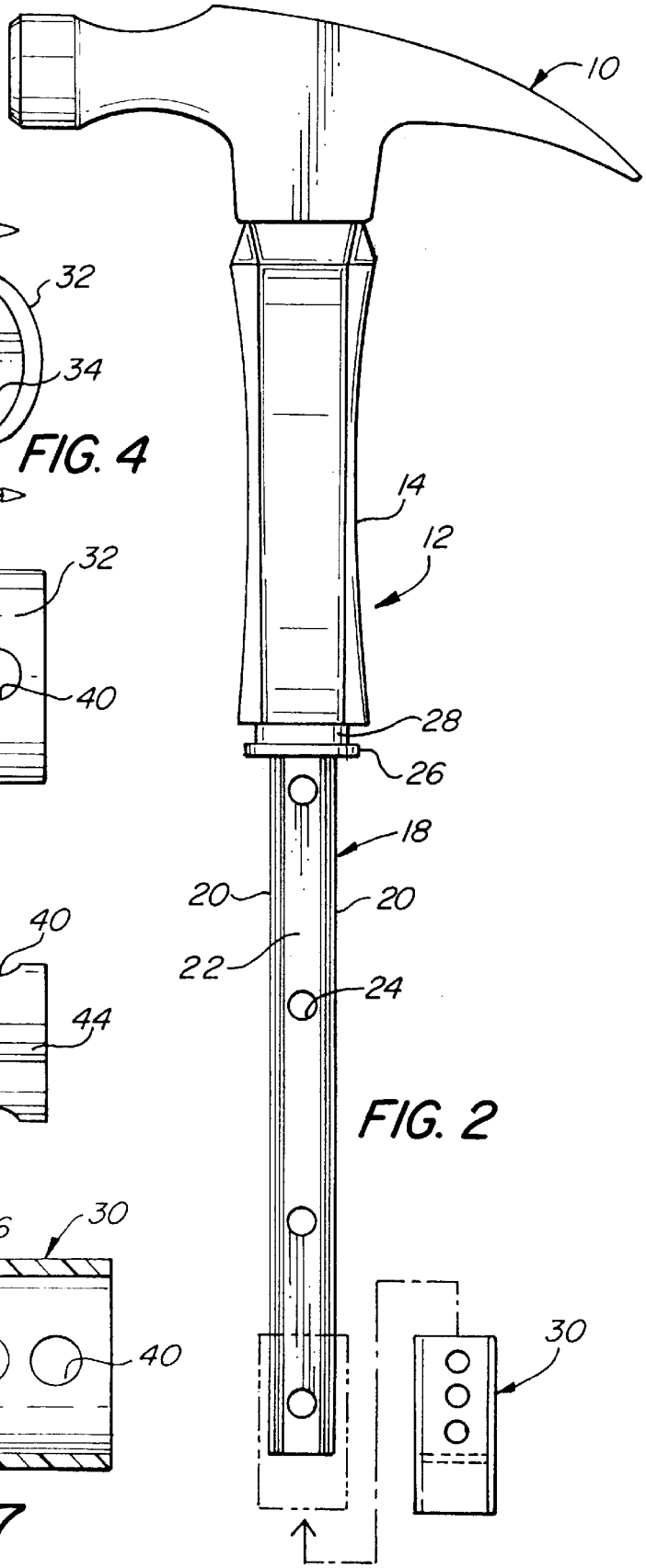
FIG. 2 is a side elevational view of the hammer without the grip and showing the canister disassembled therefrom.

As seen in FIG. 2, the sleeve has a collar 26 at its end spaced from the head 10 and a groove 28 spaced inwardly therefrom A core rod generally designated by the numeral 18 provides the structural strength to the handle 12 and has its one end seated in the eye 11 of the head 10 and fully engaged therewith Along the length of the core rod are spaced apertures 24.

As best seen in FIG. 8, the core rod 18 has convexly arcuate flanges 20 and is of generally I-shaped construction with arcuate flanges 20 and a web 22 extending therebetween. Illustrated as dissembled from the core rod 18 is a canister generally by the numeral 30 which is best illustrated in FIGS. 3–7.

The canister 30 is generally oval cross section with major and minor axes At the end of the major axes the curvilinear peripheral wall 32 has portions 44 which are defined by a shorter radius than the remainder of the peripheral wall. Extending transversely of the peripheral wall 32 is a transverse wall 34 which defines a cup portion 36 thereabove and a compartment portion 38 therebelow. The canister 30 is formed with a plurality of apertures 40 at the ends of the minor axes. A cover 42 is provided to seal the compartment portion 38 in which is disposed the damping mechanism (not shown).

The grip 16 is molded about the core rod 18 and canister 30 as illustrated in FIGS. 9 and 10, so that the material of the grip 16 extends through the apertures 24 in the web portion of the core rod 18 and through the apertures 40 in the cup portion 36 of the canister 38 so as not only to encase those elements, but also to produce a strong mechanical engagement therewith. As seen in FIGS. 9 and 10, the material of the grip 16 also encases the end of the compartment portion so that the canister 30 is fully protected by the material of the grip.

The hammer of the illustrated embodiment can be readily assembled from the individual components. Initially, the canister is molded and the damping mechanism is placed therein The cover is then sealed thereover.

The sleeve is initially molded about the upper portion of the core rod as indicated in FIG. 2, and this subassembly is assembled with the canister by pressing the canister onto the end of the core rod so that the core rod seats snugly upon the transverse wall of the canister and against the peripheral wall of the cup-shaped portion. This assembly is then placed within a mold and the fluid resin is poured into the mold so that it flows through the apertures in the core rod and in the canister to fully encapsulate the canister and the core rod as seen in FIGS. 9 and 10. As a result, the canister and thereby the damping mechanism are securely positioned within the handle and the core rod which is an intimate contact with the canister so as to effectively transmit the vibrations from the head to the damping mechanism within the canister. As will be appreciated, the damping mechanism within the canister generally will be tuned to function at a frequency equivalent to the natural frequency of vibration of the striking head so as to achieve the most effective damping.

After the handle assembly has been completed, the end of the handle is inserted into the eye or recess of the striking tool and secured therein usually by a high strength resin such as an epoxy. In addition, mechanical elements may be utilized to increase the interengagement of the handle within the head of the tool.

Although various resins may be utilized including polyurethane and epoxy for the sleeve which is adjacent to the head, in practice an ionomer resin sold by E.I. DuPont under the trademark SURLYN has proven highly effective because of its durability under the conditions of use.

Various resiliently deformable resins may be employed for the grip including plasticized polyvinyl chloride resins, polyurethanes and the like. Plasticized polyvinyl chloride has proven advantageous because of its wear characteristics and ease of molding.

Although the canisters can be made of various materials, desirably the resin selected should be one which is compatible with the resin of the grip and should have high fatigue resistance. Suitable resins include the urethane based polymer sold by Dow Chemical of Midland, Mich. under the designation ISOPLAST 300.

The core rods are conveniently made of metal, although a composite such as graphite/fiberglass may also be employed with some reduction in the efficiency of transmission of the vibrations from the head to the canister.

In assembling the canister, the cover may be sealed to the body of the canister by a separate adhesive, sonic welding or the like.

Thus, it can be seen from the foregoing detailed description and the attached drawings, that the striking tools of the present invention may be readily fabricated with the damping mechanism securely positioned and protected within the body of the handle. The resultant assembly is long lived and highly effective in operation.

Having thus described the invention, what is claimed is:

1. A hand-held vibration-damped striking tool comprising:

(a) a striking head having a recess;

(b) an elongated handle having one end seated in said recess of said head, said handle having a core member with one end extending into said recess and having spaced apertures along its length extending therethrough;

(c) a vibration-damping canister in said handle having a peripheral wall and an intermediate transverse wall providing a cup portion at its one end firmly seating the other end of said core member, said canister having a compartment portion at its other end in which is disposed vibration-damping means, said peripheral wall of cup-shaped portion having apertures extending therethrough; and (d) a grip of resiliently compressible material encasing the portion of said core member adjacent said other end thereof and said canister, said material of said grip extending through said apertures of said core member and said cup portion of said canister to effect firm engagement therewith.

2. The striking tool in accordance with claim 1 wherein said core member is metallic.

3. The striking tool in accordance with claim 2 wherein said core member has a generally I-shaped cross section with flanges and a web therebetween.

4. The striking tool in accordance with claim 3 wherein said flanges abut the peripheral wall of the cup portion of said canister to transfer vibrations thereto.

5. The striking tool in accordance with claim 1 wherein said canister has a generally oval cross section with major and minor axes and wherein the curvature of said peripheral wall at the ends of said major axis is defined by a radius which is shorter than that defining the remainder of said peripheral wall.

6. The striking tool in accordance with claim 1 wherein said other end of said core member abuts said transverse wall of said canister and said peripheral wall at the ends of said major axis.

7. The striking tool in accordance with claim 1 wherein said canister includes a cover extending across said other end thereof to seal said compartment portion.

8. The striking tool in accordance with claim 7 wherein said grip extends across said cover of said canister.

9. A hand-held vibration-damped striking tool comprising:

(a) a striking head having a recess;

(b) an elongated handle having one end seated in said recess of said head, said handle having a metallic core member with one end extending into said recess and having spaced apertures along its length extending therethrough;

(c) a vibration-damping canister in said handle having a peripheral wall and an intermediate transverse wall providing a cup portion at its one end firmly seating the other end of said core member, said canister having a compartment portion at its other end in which is disposed vibration-damping means, said peripheral wall of cup-shaped portion having apertures extending therethrough, said canister also having a cover extending across said other end thereof to seal said compartment portion; and (d) a grip of resiliently compressible material encasing said canister and the portion of said core member adjacent said other end, said material of said grip extending through said apertures of said core member and said cup portion of said canister to effect firm engagement therewith, said material of said grip also extending across said cover of said canister.

10. The striking tool in accordance with claim 9 wherein said core member has a generally I-shaped cross section with flanges and a web therebetween and said flanges abut the peripheral wall of the cup portion of said canister to transfer vibrations thereto.

11. The striking tool in accordance with claim 10 wherein said canister has a generally oval cross section with major and minor axes and wherein the curvature of said peripheral wall at the ends of said major axis is defined by a radius which is shorter than that defining the remainder of said peripheral wall, and wherein said other end of said core member abuts said transverse wall of said canister and said peripheral wall at the ends of said major axis.

12. In a method for making a hand-held vibration-damped striking tool, the steps comprising:

(a) providing a striking head having a recess;

(b) forming a core member and having spaced apertures along its length extending therethrough;

(c) forming a vibration-damping canister with a peripheral wall and an intermediate transverse wall providing a cup portion at its one end, said canister having a compartment portion at its other end in which is disposed vibration-damping means, said peripheral wall of cup-shaped portion having apertures extending therethrough; and (d) placing said core member and said canister in a mold with one end of said core rod firmly seated in said cup portion of said canister;

(e) molding resiliently compressible material about said core member and canister to encase said canister and the portion of said core member adjacent said other end to provide a grip, said material of said grip extending through said apertures of said core member and said cup portion of said canister to effect firm engagement therewith; and (f) securing the other end of said core member in said recess of said striking head to provide a handle therefor.

13. The method in accordance with claim 12 wherein said core member forming step produces a metallic core member with a generally I-shaped cross section having end flanges and a web therebetween.

14. The method in accordance with claim 13 wherein said placing step causes said flanges to abut the peripheral wall of said cup portion of said canister to transfer vibrations thereto.

15. The method in accordance with claim 12 wherein said canister forming step produces a canister with a generally oval cross section having major and minor axes and wherein the curvature of said peripheral wall at the ends of said major axis is defined by a radius which is shorter than that defining the remainder of said peripheral wall, and wherein said placing step causes said one end of said core member to abut said transverse wall of said canister and said peripheral wall at the ends of said major axis.

* * * * *